US008453262B2

(12) United States Patent
Green

(10) Patent No.: US 8,453,262 B2
(45) Date of Patent: Jun. 4, 2013

(54) PERSONAL ENVIRONMENTAL PROTECTION APPARATUS

(75) Inventor: Lawrence J. Green, Santa Ana, CA (US)

(73) Assignee: Pabban Development, Inc., Irvine, CA (US)

( * ) Notice: Subject to any disclaimer, the term of this patent is extended or adjusted under 35 U.S.C. 154(b) by 844 days.

(21) Appl. No.: 12/313,649

(22) Filed: Nov. 24, 2008

(65) Prior Publication Data

US 2010/0125934 A1 May 27, 2010

(51) Int. Cl.
*A42B 3/20* (2006.01)

(52) U.S. Cl.
USPC ..... 2/9; 2/15; 2/424

(58) Field of Classification Search
USPC ..... 2/455, 9, 410, 422, 424, 15, 450
See application file for complete search history.

(56) References Cited

U.S. PATENT DOCUMENTS

| | | | | |
|---|---|---|---|---|
| 4,805,639 | A | 2/1989 | Dial et al. | |
| 4,856,535 | A | 8/1989 | Forbes | |
| 4,945,574 | A | 8/1990 | Dagher | |
| 4,965,887 | A | 10/1990 | Paoluccio et al. | |
| 5,020,533 | A * | 6/1991 | Hubbard et al. | 128/206.23 |
| 5,878,742 | A | 3/1999 | Figueredo et al. | |
| 6,536,434 | B1 * | 3/2003 | Bostock et al. | 128/206.12 |
| 6,715,489 | B2 * | 4/2004 | Bostock et al. | 128/206.21 |
| 6,795,978 | B2 * | 9/2004 | Fournier et al. | 2/424 |
| 7,055,521 | B1 * | 6/2006 | Johnson | 128/200.28 |
| 7,703,456 | B2 * | 4/2010 | Yahiaoui et al. | 128/206.19 |

FOREIGN PATENT DOCUMENTS

| | | |
|---|---|---|
| EP | 2 189 074 A2 | 5/2010 |
| EP | 2 189 074 A3 | 10/2011 |

OTHER PUBLICATIONS

European Office Action for Application No. 09014578.0-1256 dated Jul. 3, 2012.
European Search Report for Application No. 09014578.0-1256 dated Sep. 9, 2011.
European Search Report dated Apr. 8, 2011 which is attached to EP Reference EP 2189074 A3 cited above.

* cited by examiner

*Primary Examiner* — Christopher Harmon
(74) *Attorney, Agent, or Firm* — Moser Taboada

(57) ABSTRACT

A respirator apparatus including an improved helmet or head-gear construction with a unique shield including a protective lens and cuff attachment therefor. The protective lens is a thin clear plastic sheet designed to be used as a lens with a (PAPR) respirator and the cuff is an attached fabric or similar material designed to form a facial seal around the wearer.

16 Claims, 10 Drawing Sheets

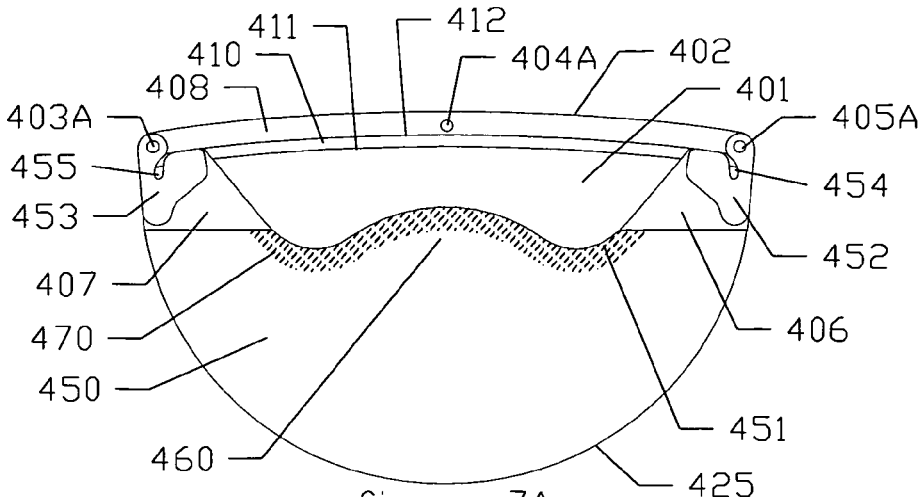
figure 7A
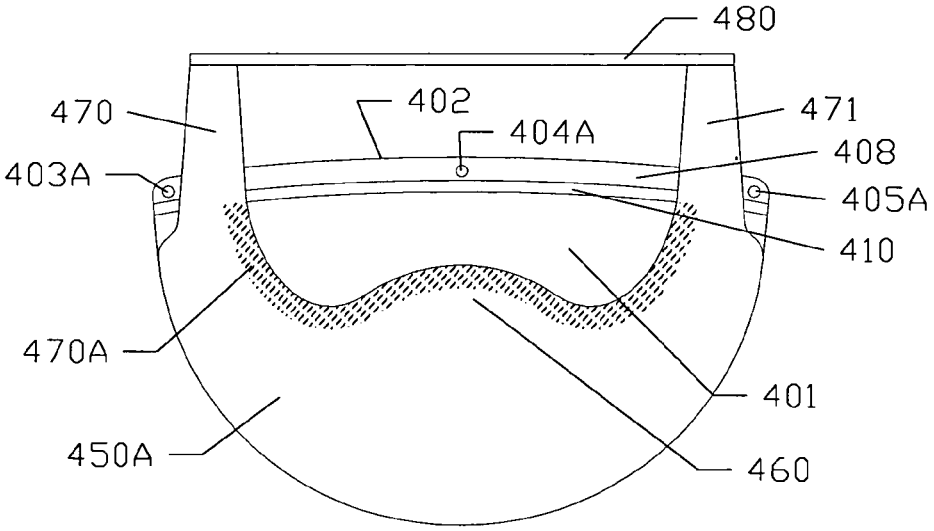
figure 7B
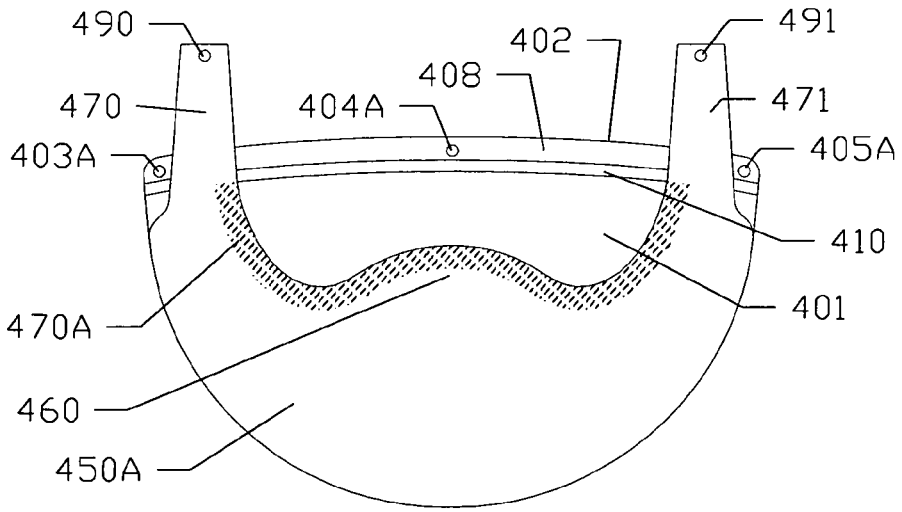
figure 7C
figure 7

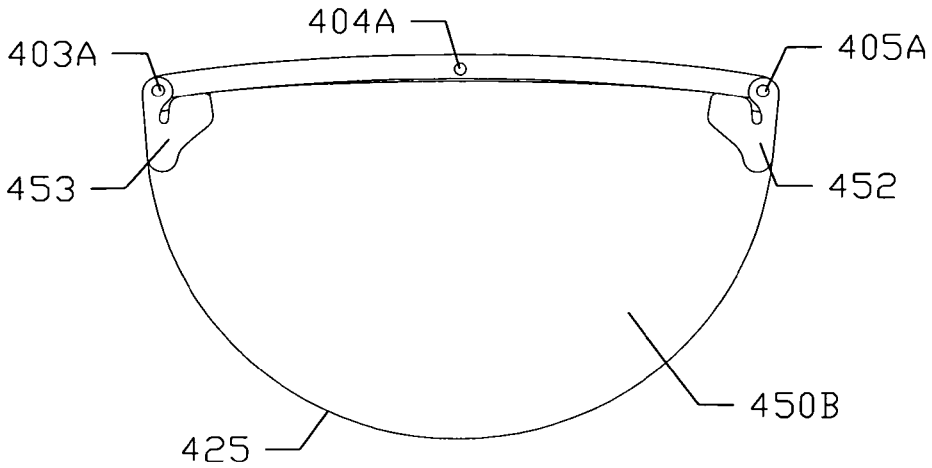
figure 8A
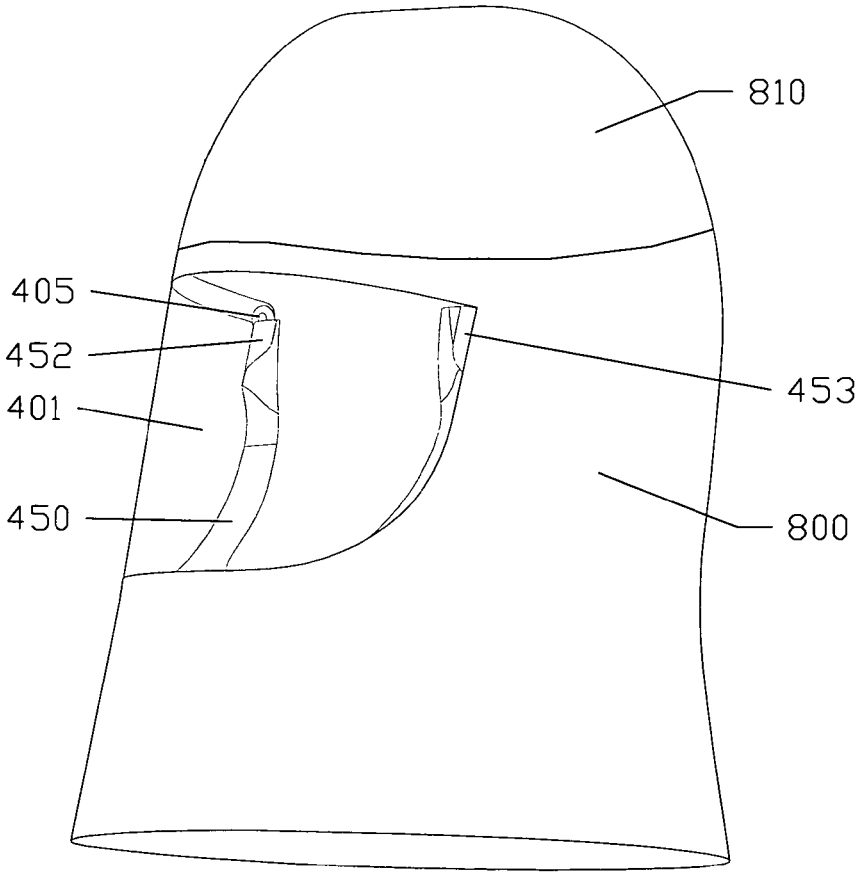
figure 8B
figure 8

PERSONAL ENVIRONMENTAL PROTECTION APPARATUS

BACKGROUND

1. Field of the Invention

This invention is directed to personal environmental protection systems, in general, and, more particularly, to a headgear structure which is worn by an individual in an environment wherein control of filtered air and protection from particulate material is required.

2. Prior Art

There are several types of air flow, filtration and protective systems which are known in the art. Several types of such systems are currently available on the market for use in surgical arenas, in "clean room" environments, or in hazardous/contaminated environments.

Some of the existing systems include hoods, gowns, filters, and the like. In some instances, the air filters are built into the helmet structure and produce a rather clumsy, cumbersome headgear unit. Known units frequently include external sources of air such as gas cylinders, air lines or the like which are connected to the helmet structure by tubes, hoses or the like. The hose-connected systems, and the long gowns or hoods tend to become extremely cumbersome as well as restrictive of the movements and flexibility of the wearer during a procedure.

Currently available lens/facial seal combinations, sometimes known as loose fitting hoods, are expensive to manufacture due to the geometries required for the facial seal to attach to the lens which is curved in a plane perpendicular to the seal to the face/head of the wearer.

In many of the systems known in the art the hoods and/or gowns are used as filtration devices which have to be replaced frequently. This structure tends, therefore, to become costly inasmuch as the disposable filtration devices are quite expensive.

Moreover, these systems tend to be fairly expensive, especially regarding the disposable portions of the system.

Many such products are known in the prior art. One suitable and functional system is described in U.S. Pat. No. 5,054,480; PERSONAL AIR FILTRATION AND CONTROL SYSTEM, R. O. Bare et al.

Other such systems are described in U.S. Pat. No. 5,711,033; AIR FILTRATION AND CONTROL SYSTEM INCLUDING HEADGEAR; L. J. Green, et al, and in U.S. Pat. No. 6,918,141; PROTECTIVE HEADGEAR SYSTEM; Lawrence J. Green et al.

Another related prior disclosure is described in co-pending application PROTECTIVE HEADGEAR SYSTEM WITH FILTER PROTECTION; Ser. No. 11/442,402; L. J. Green, filed May 30, 2006.

SUMMARY OF THE INSTANT INVENTION

This invention is directed to a protective headgear system which is worn by a surgeon during a surgical procedure, a technician during an assembly process, a worker during handling of toxic wastes, or the like.

When using respirators of certain types a protective lens and a facial seal are required. The instant apparatus provides a shield which includes an inexpensive disposable lens and facial seal combination to be used with an appropriate (PAPR) respirator. The system includes a relatively light weight, substantially rigid, support headgear structure.

An adjustable headband is attached to the headgear structure for supporting the assembled structure on the wearer's head. An outer, relatively lightweight, substantially rigid filter protector can be provided.

The system also includes one or more removable and disposable filters which are adapted to be easily and snugly attached to and supported by the headgear structure to significantly cover the outer surface of the headgear structure.

The transparent facial shield including a cuff or facial seal and a flexible lens is adapted to easily attach to the headgear structure so as to cover the face of the wearer in order to maintain sterile, non-contaminating conditions for the wearer.

The instant device uses a seal or cuff with a unique configuration which is attached flat to the lens to permit the shield to protect the face and head of the wearer when the lens is bent around the front of the respirator and cuff is pulled into juxtaposition with the wearer's face.

In particular, the flexible containment cuff is attached to the lower edge of the lens in order to enclose and provide a sealed space about the wearer's head. The shield (lens and cuff) can be manufactured as a flat, layered device which facilitates production techniques and, thereby, reduces manufacturing costs whereby this facial shield can be a disposable item.

A fan mechanism can be incorporated into the helmet system to provide air flow at the headgear structure and a suitable power supply can be used to selectively power the fan, if so desired.

BRIEF DESCRIPTION OF THE DRAWINGS

FIG. 7 includes FIGS. 7A, 7B and 7C which are front views of additional embodiments of the lens and cuff attachment alone.

FIG. 8 includes FIGS. 8A and 8B wherein, FIG. 8A is a view of another embodiment of the lens and cuff attachment with an elastic cuff; and FIG. 8B is a representation of the combination of the cuff and lens attachment and a protective hood.

DESCRIPTION OF A PREFERRED EMBODIMENT

Concurrent reference is made to FIGS. 1 through 3A which show different views of a preferred embodiment of the invention.

Figure 1:
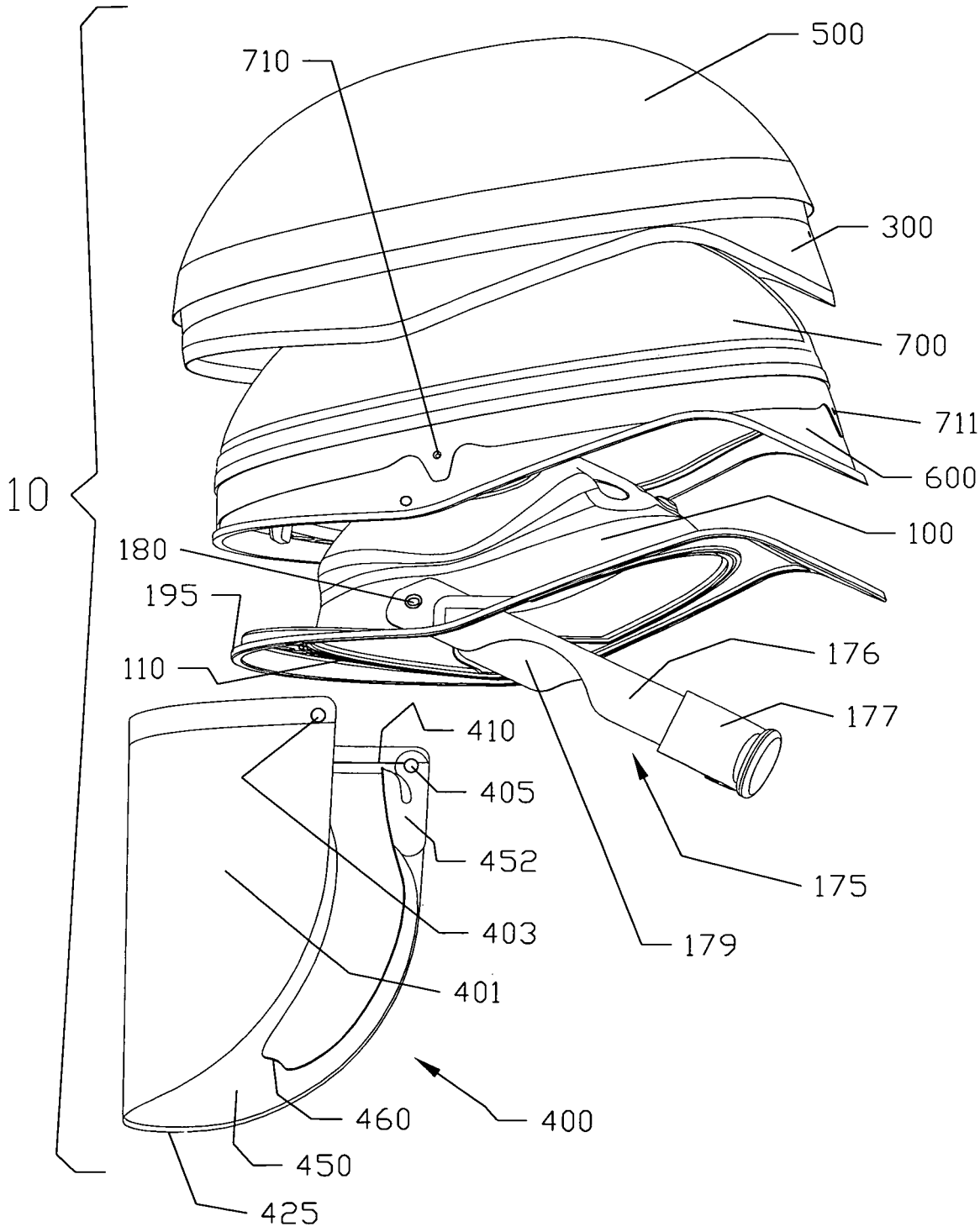
FIG. 1 is an exploded view of a helmet apparatus with the lens and cuff attachment mounted thereon.

Specifically, in FIG. 1 there is shown an exploded view of one embodiment of the helmet and facial shield assembly 10 of the instant invention. The helmet assembly 10 includes the helmet shell 600, the liner 100, the outer filter protector 500, the filter cover support 300, the headband assembly 175 and the facial shield 400 which comprises the lens 401 and the cuff (or seal) 450.

The headband 175 is used to seat the helmet 10 on the head of the wearer 500. The headband 175 is fairly conventional and is, also, optional. That is, a different head engaging support mechanism can be utilized or it can be omitted, if preferred.

In this illustrative embodiment, the headband 175 includes the head-encircling band 176 which is adjustable to comfortably fit the head size of the individual wearer. The adjustment latch 177 permits the band 176 to be shortened or lengthened in a conventional manner.

The band 176 includes suitable attachment arms 179 for attachment to the helmet liner 100 by means of suitable fasteners 180 which can be screws, staples, or the like.

The helmet liner 100 is, typically, formed of a lightweight material, such as polypropylene or LDPE, for example. Helmet liner 100 is configured to conform, generally, to the shape of the upper portion of the wearer's head but to be spaced away from the top of the head of the wearer by the appropriate spaces 101 and 102 (see FIG. 3) which can be formed in the helmet, foam pads or the like.

The frontal portion of the liner is designed to span the area between the forehead of the wearer wherein surface 120 acts as the front portion of the headband 175 or is in juxtaposition sufficiently close to minimize airflow therebetween. A surface 130 extends to the outer edge 140 of the liner which may attach to the lower perimeter of the helmet 600, if so desired. The spanning effect may also be accomplished in whole or in part by foam inserts, if so desired.

A plurality of holes 150 (seen best in FIGS. 3 and 3A) extend upwardly through the surface 130 of the liner 100 to provide for airflow therethrough and toward the contained volume about the face or the wearer.

The liner 100 has an accordion-like area 110 (better seen in FIG. 3A) which permits the liner 100 to flex and better conform to the wearer's head.

In addition, if desired, the liner 100 is sufficiently sturdy to support a cooling or air moving mechanism such as a respirator helmet 600 or the like as known in the prior art. The respirator helmet may be attached to the liner by a snap in groove, 195 around the perimeter of the liner or any other conventional means.

A fan covering (not shown) can be joined to or integrally formed to provide a protective and contouring cover for fan mechanism of any conventional type as, for example, described in U.S. Pat. Nos. D460,584 and 6,792,944. Thus, air flow channels can be defined and maintained around the helmet assembly 10 whereby an optional fan mechanism can provide a cooling and filtered air flow to the wearer of the helmet assembly 10.

A filter 700, typically, but not limitatively, fabricated of electrostatically charged fibrous plastic material (e.g., melt blown polypropylene) is configured to conform to the outer shape of the helmet shell 600 and is adapted to fit fairly snugly thereto. Features as described in U.S. Pat. No. 6,918,141 (noted supra) support the filter and create an air channel beneath it. Alternately, the filter may be so designed as to be self supporting. The level or degree of filtration of air which enters or leaves the helmet shell 600 can be controlled by appropriate selection of the material of the filter 700, Filter 700 is, typically, mounted to the helmet shell 600 with a force friction fit and by snaps around the perimeter of the helmet as illustrated by side and rear snaps 710 and 711. Of course, any suitable fastener can be utilized. As will be described infra, the top edge of lens 400 is attached to the perimeter of the helmet shell 600, the liner 100, or the filter cover support 300, if so equipped.

In this embodiment, a filter protector 500 is provided to cover the filter 700. The filter protector 500 can be fabricated of a material which is the same as (or similar to) helmet liner 100, if so desired. The filter protector 500 prevents damage to the filter 700 and, as well, prevents persons (including the helmet wearer) from touching the possibly contaminated surface of filter 700. The filter protector 500 is attached to the helmet shell 100, typically, by a force-fit or any other technique.

The rear deck (or tail) 187 of the helmet liner 100 engages the rear edge of helmet 600 and provides additional stability to the apparatus.

A facial lens 401 fabricated of an impermeable, flexible and transparent material such as polycarbonate, or the like, is adapted to be mounted to and bear against the outer front surface of filter cover support, as described infra. The juxtaposition of the inner surface of the lens 401 and the outer surface of the filter cover support provides a seal therebetween. A sealing means 410 as described infra or other suitable means may be provided to enhance the seal.

The cuff 450 is fabricated of a sheet of pliant material such as rayon or thin plastic or meltblown polypropylene. The cuff 450 also serves as a protective barrier to prevent particulate material from being transmitted to or from the wearer to or from the ambient.

The cuff 450 is attached to the lens 401 along a seam 425. The mid-portion of cuff 450 is adapted to be tucked under the chin of the wearer.

Figure 3:
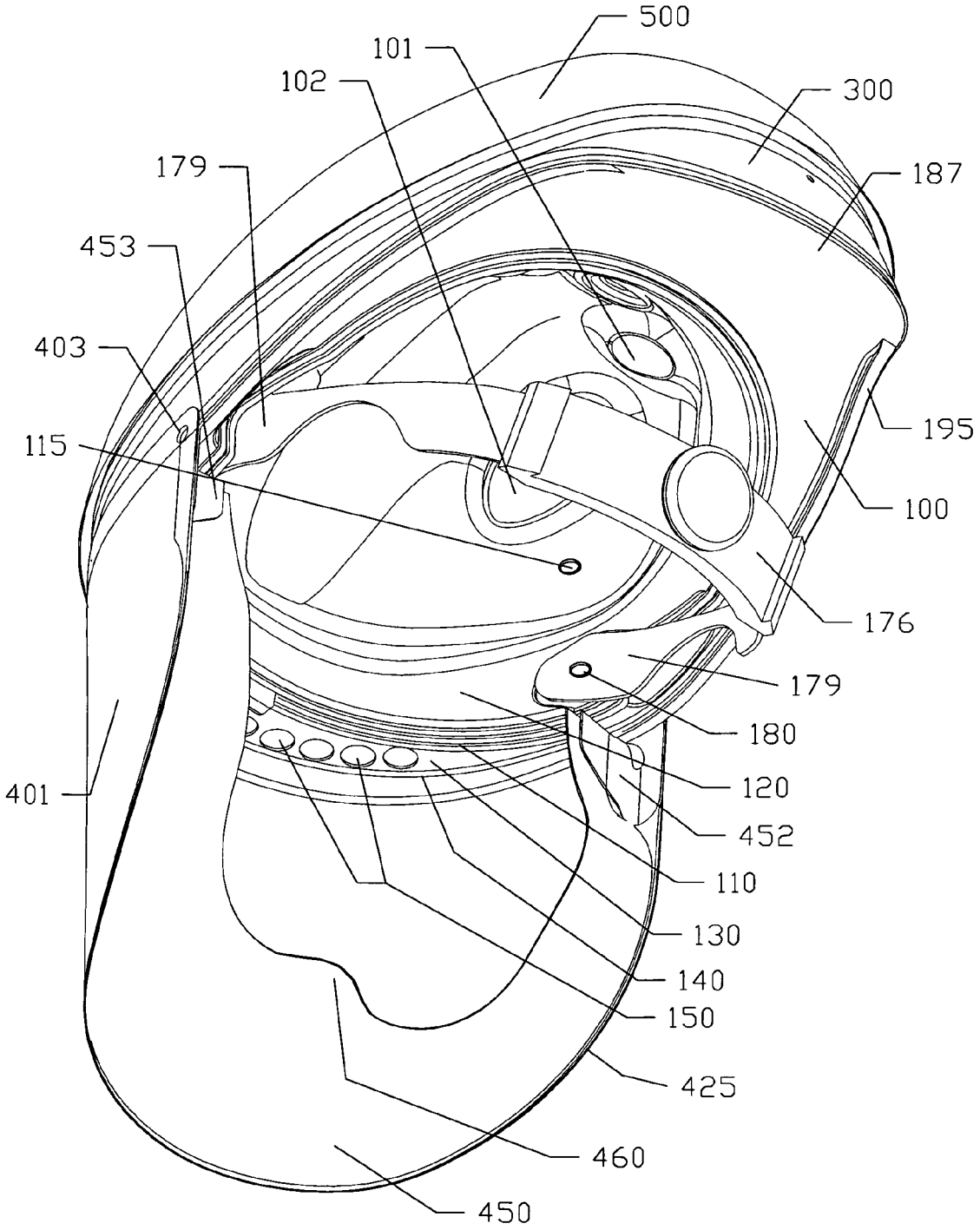
FIG. 3 is an oblique view of the apparatus shown in FIGS. 1 and 2 without the schematic head.
Figure 3A:
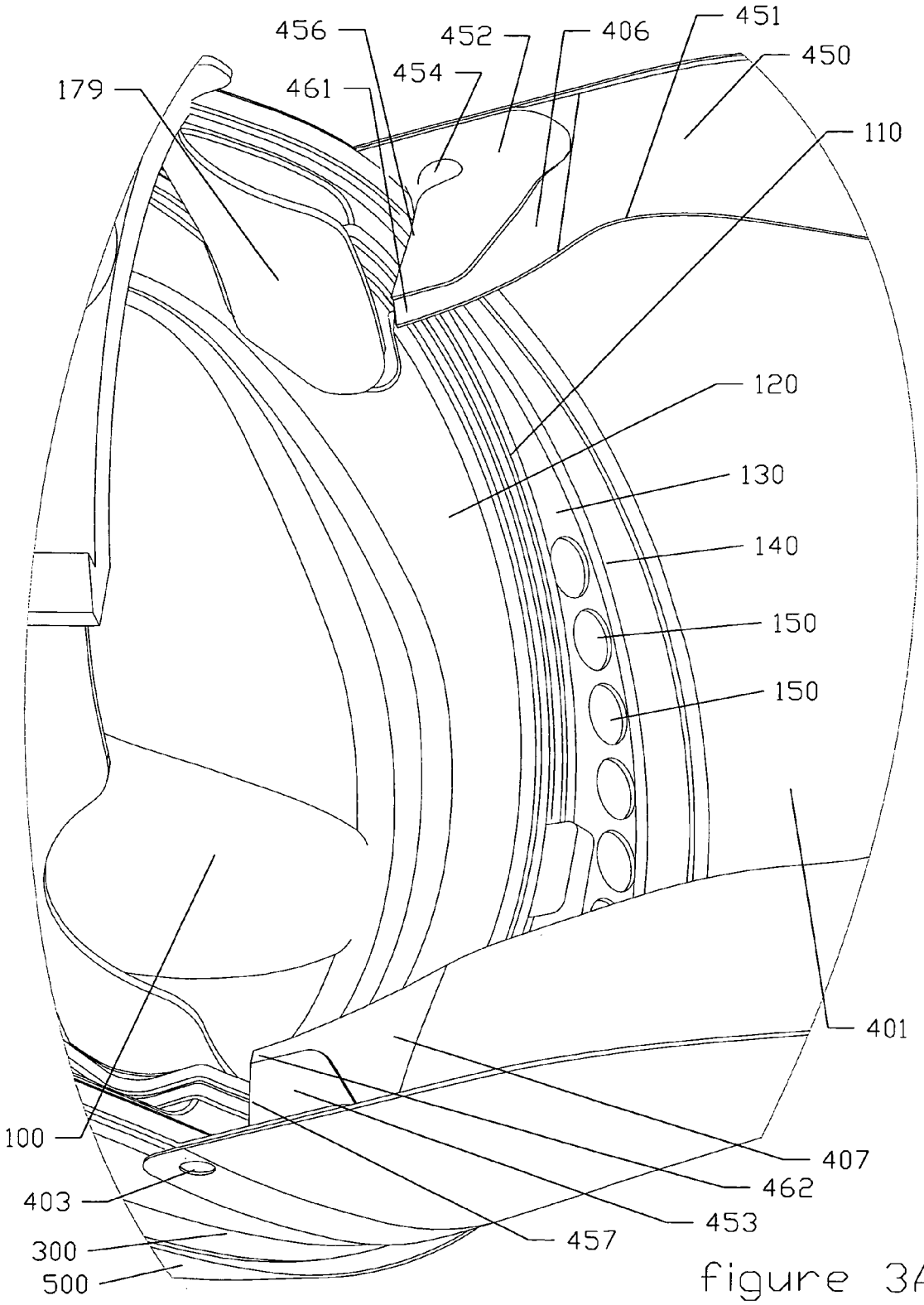
FIG. 3A is an enlarged view of a portion of the apparatus shown in FIG. 3.

Referring now to FIG. 3A, there is shown an enlarged view of a portion of the view of the apparatus shown in FIG. 3. This enlarged view shows the arrangement of the holes 150, and the accordion-like area 110.

Also, the interaction of the shield 400, the liner 100, and the support tabs 451 and 452 is shown in greater detail.

Notably, the upper edges 456 and 457, respectively, of support tabs 452 and 453 are held in close proximity to the extension of liner surface 130. Likewise, the support tabs maintain the upper extensions 461 and 462 of cuff free edge 451 in close proximity to the wearer's head, as better seen in FIG. 5.

Thus, it is contemplated that facial shield 400 comprising lens 401 and protective cuff 450 can be joined together as a subassembly and placed over the helmet shell 600, in concert with liner 100 or spanning means to define an enclosed volume about the face of the wearer thereby providing or enhancing the filtering and protecting functions described.

The M-shaped cuff 450 includes the enlarged portion 460 at the mid-portion thereof. This "bump" or "nose" portion is provided in order to provide a secure engagement under and with the chin of the wearer of the helmet.

Suitable connectors (or attachments) 403, 404 and 405, such as sections of hook-and-loop material, holes for engaging snap posts or an adhesive strip may be applied near the upper edge 402 of lens 401. These connectors (or adhesive strip) can be used to attach the upper edge 402 of lens 401 to the front of the helmet liner 100, helmet 600 or filter protector support 300 (see FIGS. 1 and 4).

In some embodiments it may be desirable to have a strip 410 of sealing material such as foam, a rubber tube or other compressible strip which can engage the front of the liner 100 or helmet 600 providing an enhanced seal thereto.

In a preferred embodiment the seal is a thin strip 410 of pretensioned elastic applied flat to lens 401 and adhered along one side to create a fixed edge 412 and a free edge 411 such that when the lens 401 is bent the free edge 411 will seek a smaller radius of curvature, with an arc length closer to its untensioned length, than the fixed edge 412. This causes the surface 413 to tend toward perpendicular to the surface of lens 401. Thus an inexpensive gasket is produced with a spanning capability equivalent to the width of surface 413.

Figure 4:
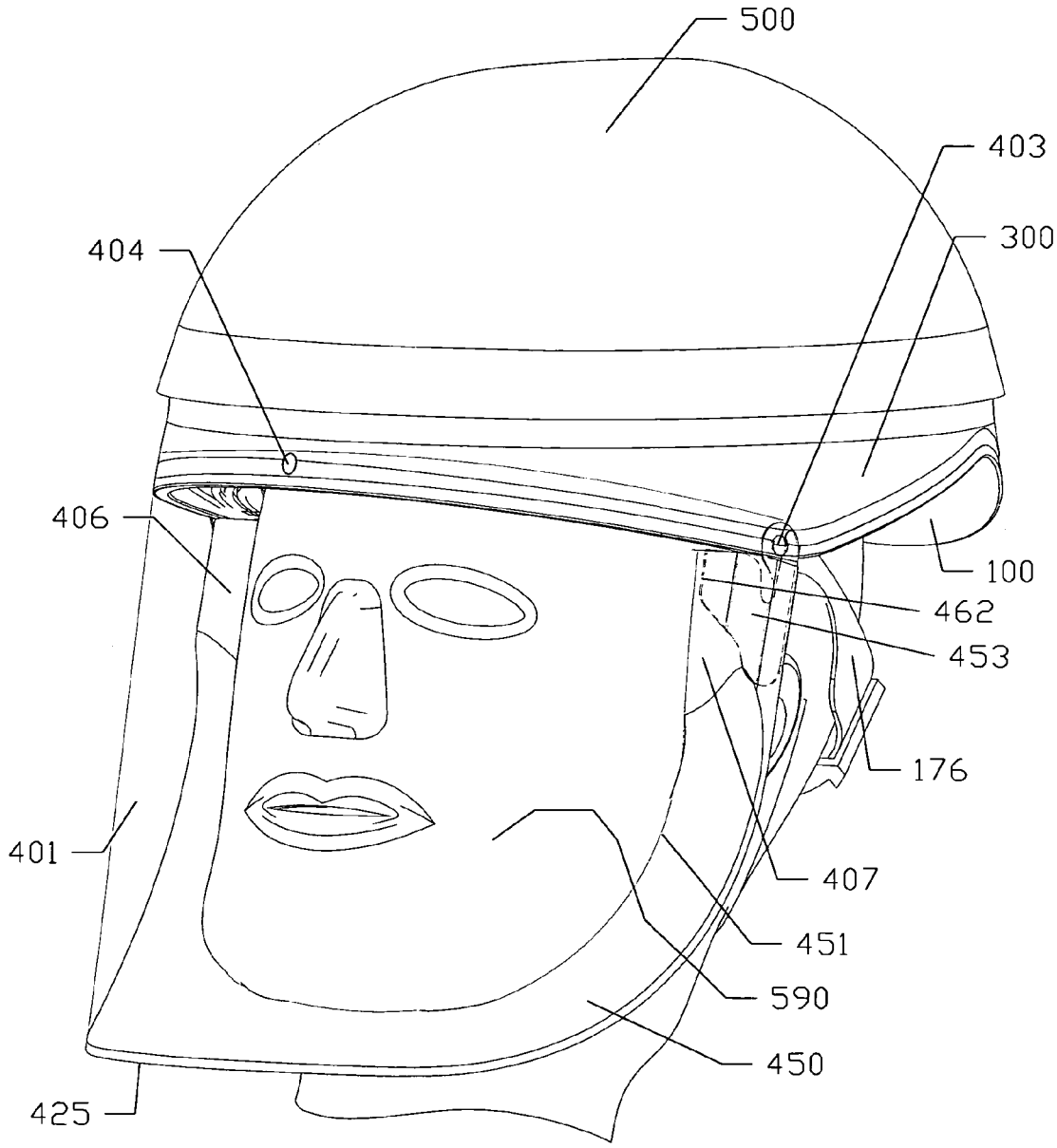
FIG. 4 is a frontal view of the apparatus on a schematic representation of a wearer's head.
Figure 5:
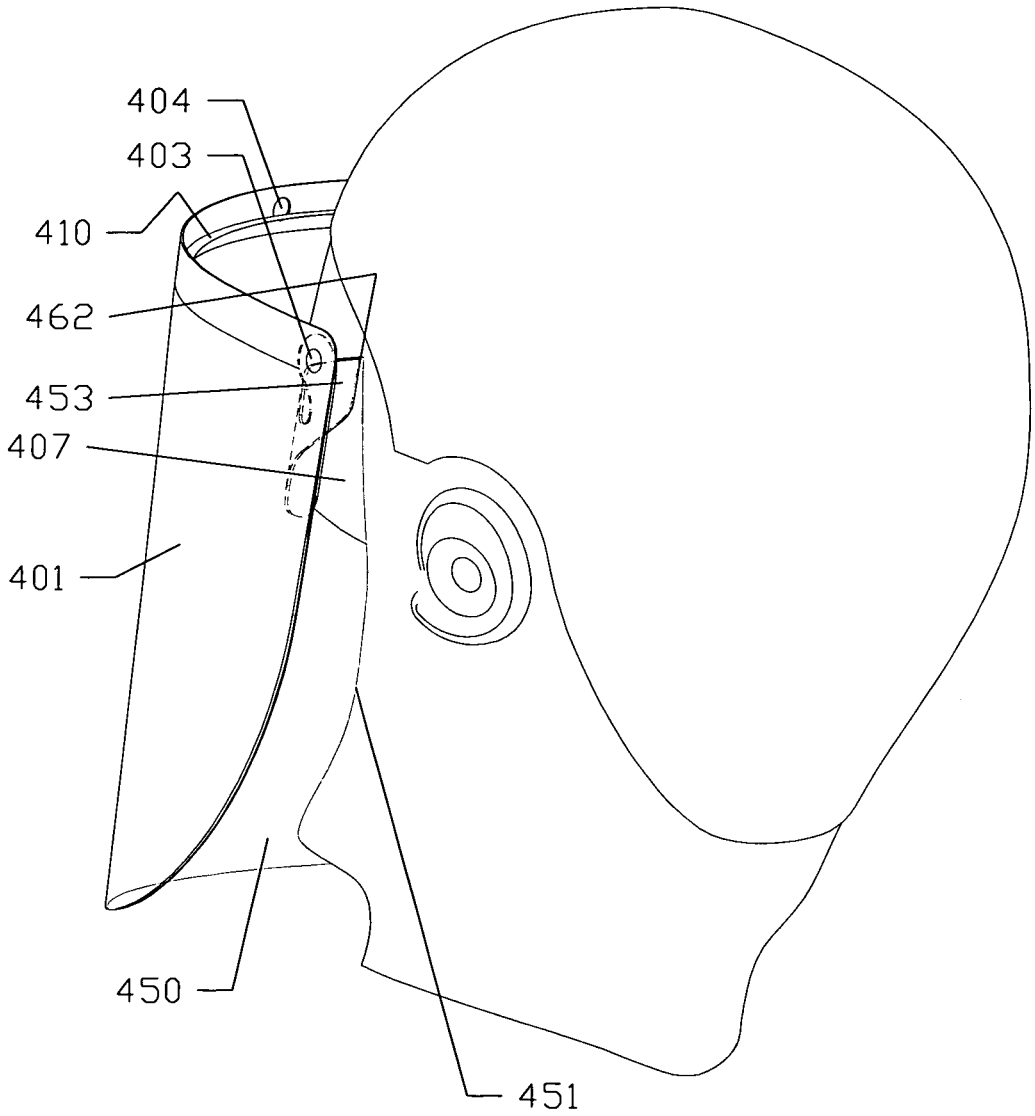
FIG. 5 is a curvilinear rear view of the lens and cuff attachment shown in FIG. 4 as shaped to conform to the head of a wearer.
Figure 6:
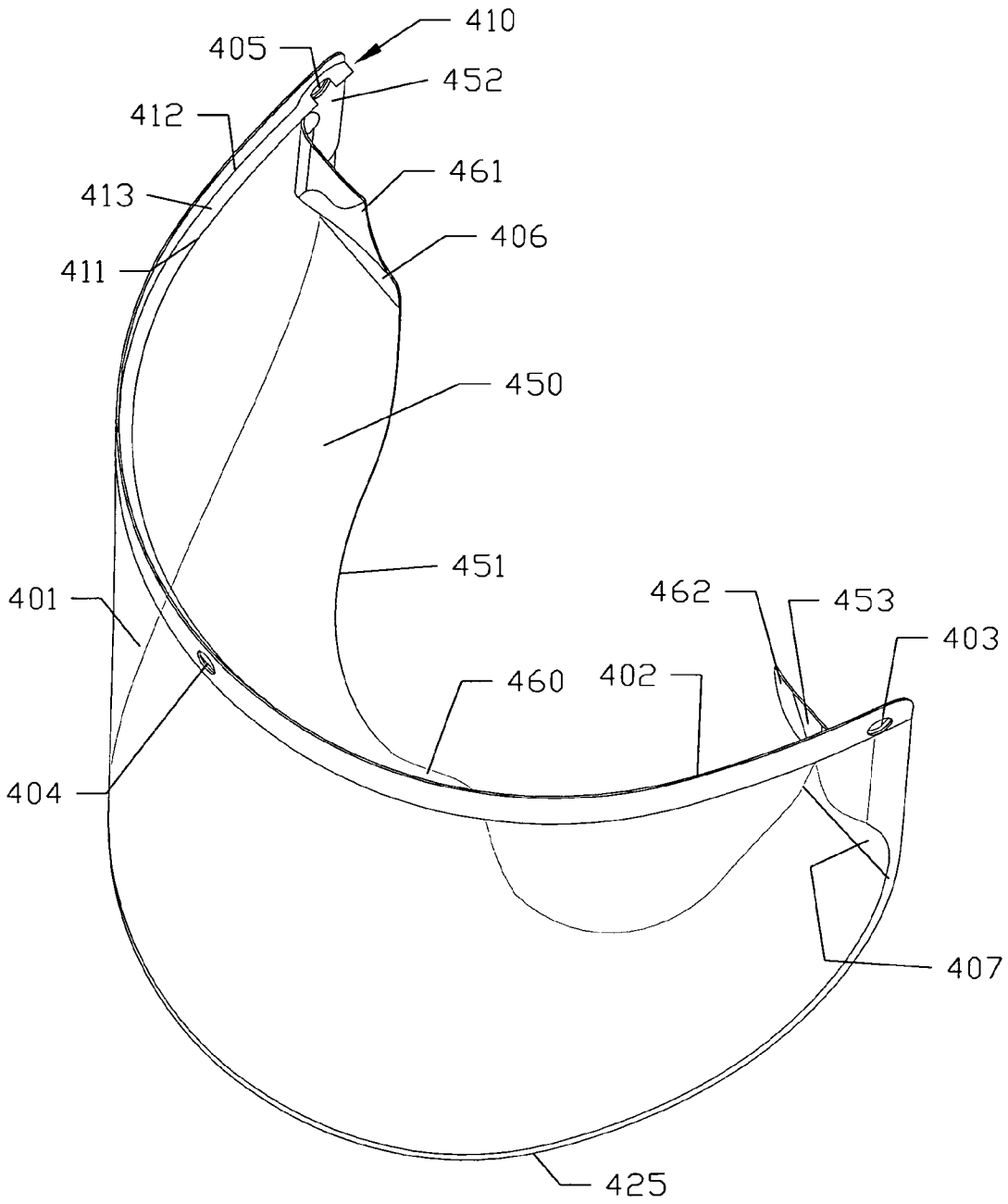
FIG. 6 is a curvilinear perspective view of the lens and cuff attachment shown in FIG. 5 without the representative wearer.

Referring now to FIGS. 4, 5 and 6, there is shown a typical application of the lens/cuff assembly. (The helmet 10 is omitted from FIGS. 5 and 6 for clarity of description. Moreover, the shield 400 can be used with many types and shapes of helmets which incorporate a suitable connector or attachment mechanism.)

As seen, the cuff 450 is separated from the lens 401 (except at the joinder edge 425). Concurrently, the lens 401 is curved into a generally semi-circular configuration to surround the wearer's head.

The connectors 403 and 404 ((a similar connection 405 is seen in FIG. 6) are attached to a counterpart connector on the front of the filter cover support 300 (not shown). Thus, the lens 401 assumes a curvilinear configuration in front of the face to the wearer 590 of the helmet.

At the same time, the cuff 450, in particular the nose 460 (see FIGS. 7A, 7B and 7C) is placed under the chin of the wearer 590 to enhance the gripping of the chin by the cuff and the protection provided thereby. The edge 451 of the cuff 450 otherwise engages the neck and throat area of the wearer 590, as best seen in FIG. 5. The cuff 450 also engages the sides of the head of the wearer 590 and forms a protective surface therearound.

The flexible support tabs 452 and 453 are arranged to cause the cuff 450 to maintain the preferred shape surrounding the head of the wearer 500, as described supra. Specifically they interact with the tension created along the edge 451 by the insertion of the wearers face to draw the upper extension of the free edge 462 (and similarly 461 shown in FIG. 6) into contact or close proximity of the temple area of the wearers head thus extending away from the joinder edge 425 into abutment with the upper or temporal portion of the head of the wearer 590.

The optional slots 454 and 455 are provided to accept and engage a portion of the edge of the helmet liner 100, if desired.

Figure 2:
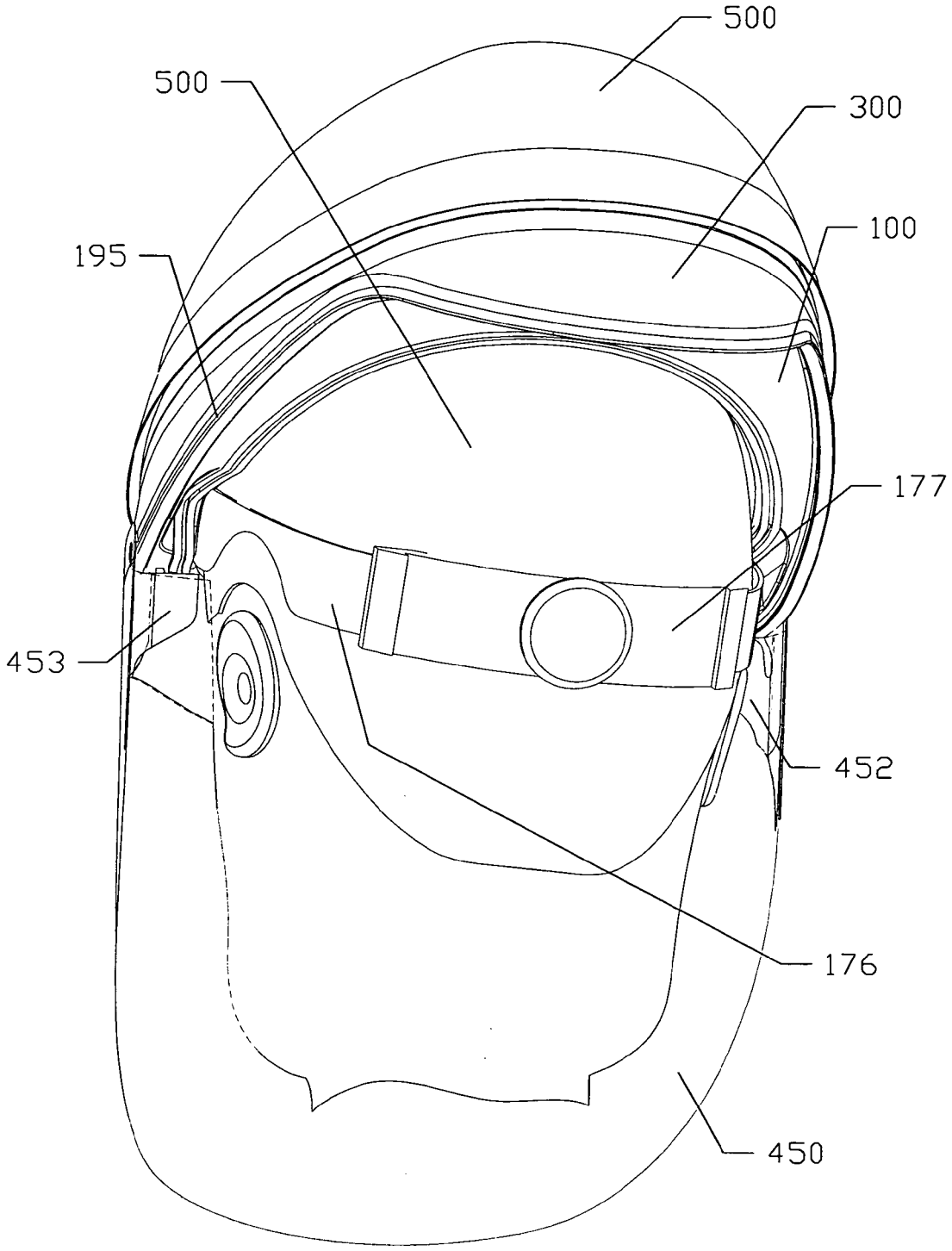
FIG. 2 is a rear view of the apparatus shown in FIG. 1 on a schematic representation of a wearer's head.

In FIG. 6, there is shown a perspective view of the lens and cuff attachment to be used with the helmet shell 100 shown in prior FIGS. 1, 2 and 3.

As described supra, the lens 401 is fabricated of a thin sheet of transparent polycarbonate (or similar) plastic. A suitable thickness is about 0.01 inches thick although thicker or thinner materials may be used.

The cuff 450 is fabricated of a suitably supple material such as but not limited to rayon, meltblown polypropylene, latex rubber or the like and is about 0.01 inches thick dependent on the characteristics of the material.

The lens 401 and cuff 450 are joined together at the curved edge 425 by any suitable means such as gluing, stitching or the like.

The free edge 402 of lens 401 is shaped to properly mate with the front edge of the helmet liner 100 and/or filter protector support 300, as described supra.

The free edge of the cuff 451, in a preferred embodiment, is formed in an undulating, generally, M-shape with nose 460, better seen in FIGS. 7A, 7B and 7C.

Support tabs 452 and 453 can be provided at the upper ends of the cuff 450 adjacent to the respective ends of the curved end 425. The support tabs permit advantageous fitting of the cuff to helmet. Typically, the tabs 452 and 453 are flexible about an axis parallel to the flat surface of the tab but less so in other directions.

In some embodiments, it is desirable to provide the slits 454 and 455 for engaging the edges of the helmet liner 100.

Referring concurrently now to FIG. 7, and particularly to FIGS. 7A, 7B and 7C, there are shown additional embodiments of the shield combination 400 of lens 401 and cuff 450. FIGS. 7A, 7B and 7C demonstrate the ability of these devices to be manufactured in a flat or two-dimensional configuration which is more easily achieved with automated production equipment.

In FIG. 7A, the lens 401 includes an adhesive band 408 attached at the upper edge thereof. The adhesive band 408 replaces the hook-and-loop connectors 402, 403 and 405, holes 402A, 403A and 405A or other features are used to assist in alignment. The adhesive band 408 can be a multiple use adhesive for re-adhering the shield to the helmet, if desired. Typically, the adhesive band 408 is a tacky material so that the shield 400 can be removed from the helmet and discarded after use.

In this embodiment, the flexible supports 452 and 453 include the slots 454 and 455 therein. In addition, flexible gores 406 and 407 are included between the ends of the cuff 450 and the supports 452 and 452, respectively. The flexible gores permit some stretchability or elasticity in the structure of cuff 450. The gores can be fabricated of any suitable stretchable material such as spandex or latex rubber.

In FIG. 7B, there is shown another embodiment of the shield 400. In this embodiment, the lens 401, similar to the lens 401 in FIG. 7A in that it includes an adhesive band 408 and/or attachment features 402, 403 and 405 at the edge thereof. The nose 460 is provided along the free edge 451 of the cuff 450.

In the embodiment shown in FIG. 7B, the cuff 450A has elongated end portions 470 and 471 which extend beyond the edge 402 and band 408 of the lens 401. An elastic band (or cord) 480 is affixed to the ends 470 and 471 in any suitable fashion.

The elastic band 480 can be stretched to pass over the helmet, head and/or nape of the neck of the wearer and then contract to form a reasonably snug but comfortable fit of the cuff 450A to the wearer. This structure allows the entire cuff to be made of a less expensive non-stretchable material such as SMS polypropylene or a cellulose non-woven. Alternatively, a tie, drawstring or other securing means can be used to secure the helmet/shield apparatus to the wearer. The lens 401 and cuff 450, thus, provide a protective barrier for the face of the wearer.

In FIG. 7C, there is shown another embodiment of the shield 400. In this embodiment, the lens 401 and adhesive band 408 are similar to those shown in FIG. 7B. Likewise, the cuff 450A with the elongated ends 470 and 471 is shown.

However, in this embodiment, the ends 470 and 471 include openings 490 and 491, respectively therethrough.

In this case, the openings (or holes) 490 and 491 can be utilized to engage suitable mounting devices, such as knob 115 shown on the helmet liner 100 in FIG. 3.

Alternatively, a cord, elastic band, or other suitable securing components attached to helmet liner 100 can be utilized, as well.

Referring now to FIG. 8, particularly the embodiment shown in FIG. 8A, the entire cuff 450B can be made of an extremely stretchable material with an elasticity of greater than 300%, such as latex or silicone rubber. In this structure the free edge of the cuff 450B can assume any shape. The support tabs 452 and 453 or features similar to 612 and 613 or 610, 611 and 620 would provide means to draw the free edge into communication with the wearers head. As these materials tend to be expensive or uncomfortable against the wearers face this is considered less desirable.

Referring to FIG. 8B, the lens and cuff assembly 400 may be attached to a hood 800 such as is described in U.S. Pat. No. 5,054,480; Bare, et al noted supra. The hood 800 is designed for use with a similar helmet structure as previously described. Within the hood 800, the cuff 450 defines a smaller space volume about the face of the wearer which is being easier to restrict contaminant entry thereto.

In this configuration, the filter protector 300 as described supra is omitted and the hood 800 encloses the wearer's head, as well as the helmet. At least a portion 810 of the hood can be constructed of a permeable material such as open cell foam, felt or meltblown polypropylene so as to provide airflow therethrough and into filter 600 (see FIG. 1).

If desired, the permeable portion 810 may be constructed of an electrostatically charged meltblown polypropylene or other filter media thereby acting as a prefilter for filter 600, or in some instances as a filter in lieu of filter 600.

Figure 9:
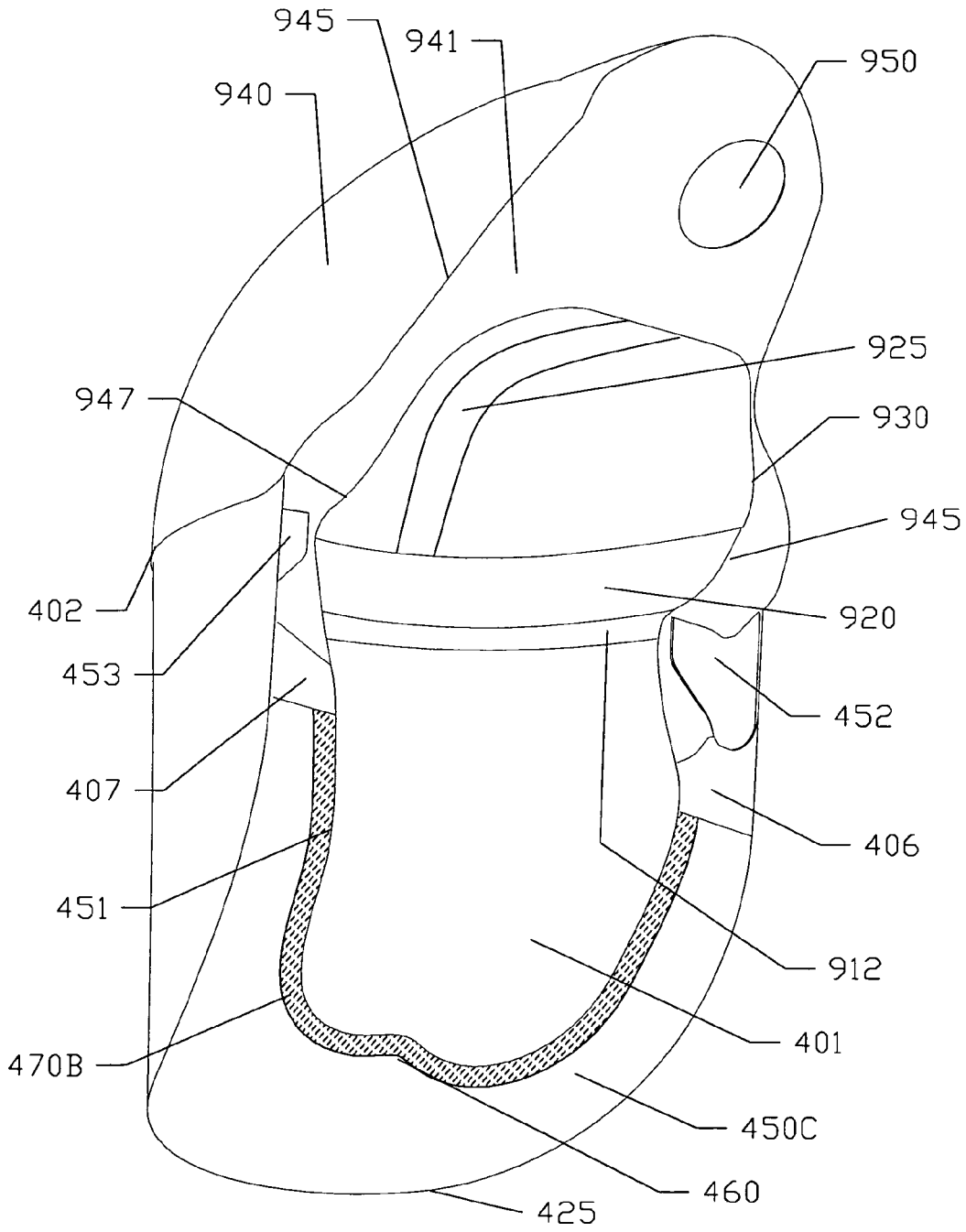
FIG. 9 is another embodiment of the cuff and lens attachment with a unitary support structure.

Referring now to FIG. 9, the lens and cuff assembly 400 may be attached to a support structure allowing it to form the contained volume about the wearers face with out requiring a ridged supporting structure or helmet.

In this configuration, lens 400 is similar to previous configurations in that cuff 450C is attached to lens 401 about edge 425, the free edge 451 of cuff 450C contains nose 460, support tabs 452 and 453 and stretchable gores 406 and 407 are included, if so desired.

An extension 941 to cuff 450C has free edge 947 extending from edge 451 to create a closed profile which encircles the wearer's head. Headband 920 is attached to free edge 947 at joinders 946 and 947 by sewing or other conventional means. This arrangement causes the headband to rest against the wearer's forehead thereby stabilizing the hood on the wearer's head. A second strap 925 is installed to extend across the top of the wearer's head, if desired.

A second ply 940 of material is attached to the upper edge 402 of lens 401. The second ply is attached to cuff extension 941 along edge 945 by sewing or other conventional means to create a contained volume about the wearers face and head, if desired.

An opening 950 is provided in cuff extension 942 for attachment of an air supply means.

Referring again to FIGS. 7A, 7B, 7C and 9, the areas 470A respectively, adjacent to the free edge 451 of the cuff 450 may be cut in a pattern of interlocking lines (or strips) which will allow some give or stretch in a normally non-stretchable material such as SMS meltblown polypropylene, cellulose non-woven, or the like as described supra. The elastic recovery capability of this patterned area may be enhanced by the adhesion of elastic fibers of hot melt adhesive or the like, if so desired.

Thus, there is shown and described a unique design and concept of a respirator apparatus. While this description is directed to particular embodiments, it is understood that those skilled in the art may conceive modifications and/or variations to the specific embodiments shown and described herein. Any such modifications or variations which are within the purview of this description are intended to be included therein as well. It is understood that the description herein is intended to be illustrative only and is not intended to be limitative. Rather, the scope of the invention described herein is limited only by the claims appended hereto.

The invention claimed is:

1. A protective headgear apparatus comprising,
a facial shield including first and second thin sheets of material which substantially overlie each other,
said first sheet of material is impermeable, flexible and transparent,
said second sheet of material is pliant,
said first and second sheets of material each having a first portion of the perimeters thereof having the same curvilinear configuration,
said first portion of said first and second sheets of material securely joined together along the curvilinear portion to form a lower edge of said facial shield such that said facial shield is able to lie flat,
said first and second sheets of material each having a second portion of the respective perimeters thereof which are selectively separable from each other, said second portion of said second sheet forming a free edge of said second sheet upon separation from said first sheet, and
at least one flexible support tab having one edge securely joined to at least one of said first and second sheets adjacent to said first portions thereof, and
tension provided along the free edge of said second sheet upon separation from said first sheet causes at least a portion of said support tab to tend towards perpendicular to the plane surface of said first sheet.

2. The apparatus recited in claim 1 wherein,
said second portion of the perimeter of said first sheet of material is a substantially straight edge.

3. The apparatus recited in claim 1 wherein,
said second portion of the perimeter of said second sheet is a curved edge.

4. The apparatus recited in claim 1 including,
a support structure for supporting said facial shield thereon.

5. The apparatus recited in claim 4 including,
attachment means for attaching said facial shield to at least a section of said support structure.

6. The apparatus recited in claim 4 wherein,
said support structure comprises a helmet structure.

7. The apparatus recited in claim 3 wherein,
said second portion of said second sheet is formed in an undulating generally "M" shape.

8. The apparatus recited in claim 1 wherein,
a portion of said second sheet adjacent to free edge is cut in an interlocking chevron pattern allowing the cut portion to elongate.

9. The apparatus recited in claim 8 wherein,
elastic fibers are bonded to said cut portion to enhance the elastic recovery thereof.

10. The apparatus recited in claim 1 wherein,
a portion of said second sheet is elastic.

11. The apparatus recited in claim 1 wherein,
said second portion of said first sheet extends beyond said second portion of said second sheet.

12. The apparatus recited in claim 11 wherein,
said second sheet has an aperture therethrough.

13. The apparatus recited in claim 4 wherein,
said support structure includes accordion folds to enhance the flexibility thereof.

14. The apparatus recited in claim 1 wherein,
said apparatus comprises a lens and a cuff to define an enclosed area about a wearer's face.

15. The apparatus recited in claim 1 wherein,
said support tab extends from said one edge thereof toward said second portion of the perimeter of said second sheet.

16. The apparatus recited in claim 1 wherein,
said support tab flexes around said one edge in order to selectively separate said second portions of said first and second sheets of material.

* * * * *